US008414084B2

(12) United States Patent
Monyak et al.

(10) Patent No.: US 8,414,084 B2
(45) Date of Patent: Apr. 9, 2013

(54) ADAPTIVE SLEEVE RETAINER FOR TOOL PICK

(75) Inventors: Kenneth Monyak, Abingdon, VA (US); Joseph Fader, Abindgon, VA (US); Patrik Burehäll, Enskede (SE)

(73) Assignee: Sandvik Intellectual Property AB, Sandviken (SE)

( * ) Notice: Subject to any disclaimer, the term of this patent is extended or adjusted under 35 U.S.C. 154(b) by 388 days.

(21) Appl. No.: 12/815,594

(22) Filed: Jun. 15, 2010

(65) Prior Publication Data

US 2011/0006588 A1 Jan. 13, 2011

Related U.S. Application Data

(60) Provisional application No. 61/224,980, filed on Jul. 13, 2009.

(51) Int. Cl.
*E21C 35/197* (2006.01)

(52) U.S. Cl. ..... 299/107

(58) Field of Classification Search ..... 299/107
See application file for complete search history.

(56) References Cited

U.S. PATENT DOCUMENTS

| | | | | |
|---|---|---|---|---|
| 3,841,708 | A | 10/1974 | Kniff et al. | |
| 4,818,027 | A * | 4/1989 | Simon | 299/107 |
| 4,836,614 | A * | 6/1989 | Ojanen | 299/107 |
| 5,526,593 | A * | 6/1996 | Coppage | 37/452 |
| 5,725,283 | A | 3/1998 | O'Neill | |
| 6,113,195 | A | 9/2000 | Mercier et al. | |
| 6,702,393 | B2 * | 3/2004 | Mercier | 299/107 |
| 6,824,225 | B2 | 11/2004 | Stiffler | |
| 7,118,181 | B2 * | 10/2006 | Frear | 299/104 |
| 2007/0257545 | A1 | 11/2007 | Mouthaan et al. | |
| 2009/0051212 | A1 | 2/2009 | Monyak et al. | |
| 2009/0058173 | A1 | 3/2009 | Monyak et al. | |

FOREIGN PATENT DOCUMENTS

| | | |
|---|---|---|
| DE | 2 330 297 | 1/1974 |
| DE | 197 20 635 C2 | 11/1998 |
| DE | 100 40 562 C2 | 3/2002 |
| DE | 602 09 235 T2 | 8/2006 |

OTHER PUBLICATIONS

German search report from related German patent application No. 10 2010 031 297.5, dated Apr. 13, 2011; 4 pages.

* cited by examiner

*Primary Examiner* — John Kreck
(74) *Attorney, Agent, or Firm* — Morgan, Lewis & Bockius LLP

(57) ABSTRACT

A tool pick assembly is provided for insertion in a first bore having a first diameter. The tool pick assembly includes a tool pick having a shank with a diameter sized for receipt in a second bore having a second diameter, the second diameter being smaller than the first diameter, an adaptive sleeve retainer having a thickness for stably supporting the shank of the tool pick in the first bore, and a washer for compressing the adaptive sleeve retainer to aid insertion into the first bore. The adaptive sleeve retainer is configured to spring radially outward to retain the tool pick in the first bore. A push out force for pushing the tool pick out from the first bore is approximately ±10% of a push out force for pushing out from the first bore a tool pick having a shank with a diameter sized for receipt in the first bore.

21 Claims, 6 Drawing Sheets

FIG. 2
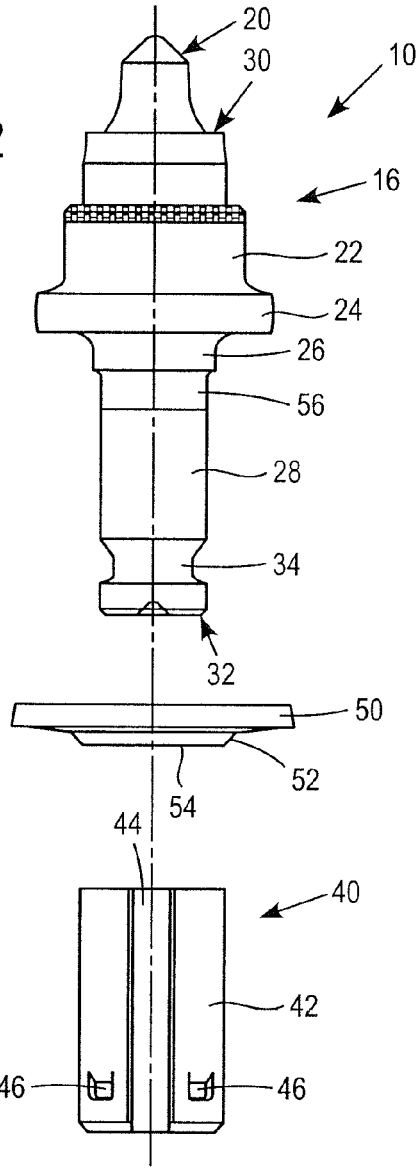
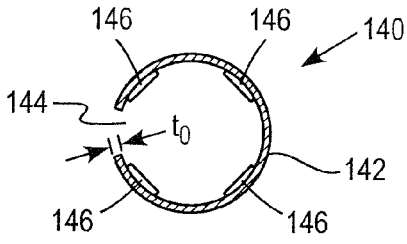
PRIOR ART
FIG. 3A
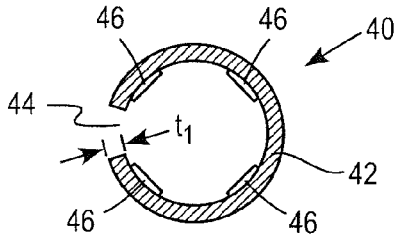
FIG. 3B

ADAPTIVE SLEEVE RETAINER FOR TOOL PICK

RELATED APPLICATION DATA

This application claims priority under 35 U.S.C. §119(e) to U.S. Provisional Application No. 61/224,980, filed Jul. 13, 2009, the entire contents of which are incorporated herein by reference.

FIELD

The present disclosure relates to an adaptive sleeve retainer for retaining a tool pick in a block. More particularly, the present disclosure relates to an adaptive sleeve retainer that fits about a shank of a rotatable tool pick to form a tool pick assembly that is inserted into a bore of a block to form a cutting tool assembly.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Cutting tool assemblies used to cut hard surfaces, such as rock and asphalt, typically include a rotating wheel or drum with a plurality of cutting tools or tool picks mounted around circumference of the wheel or drum. Each tool pick is part of a tool pick assembly that is rotatably mounted within a cylindrical bore of a block, the block being mounted to the rotating drum. Because the material cut by such tool picks is abrasive, the tool picks become worn quickly, and frequently need to be replaced, sometimes on a daily basis. Therefore, replacement of such tool picks must be relatively easy to accomplish.

A tool pick assembly typically includes a tool pick, a sleeve retainer, and a washer. Each tool pick typically includes a tool body, a frontward projecting tapered cutting tip extending outwardly from one end of the tool body and a rearward projecting shank extending outwardly from an opposite end of the tool body. Disposed between the tool body and the shank is a raised shoulder having a diameter larger than the shank but smaller than an adjacent portion of the tool body. The sleeve retainer is disposed about the shank to retain the tool pick within the bore of the block or within a sleeve as disclosed in U.S. Pat. No. 5,725,283, which is incorporated by reference herein in its entirety. The washer may be used to circumferentially compress the sleeve retainer to aid in insertion of the tool pick assembly into the bore in the block. When assembled, the raised shoulder portion of the tool pick is disposed adjacent to the washer, which in turn is adjacent to the block, and the cutting tip is exposed for cutting. In use, the tool pick rotates freely within the sleeve retainer so that the cutting tip wears evenly.

At least two differently sized tool pick assemblies are commonly used in the industry, a first size being defined by a 19.9 mm diameter block bore (nominally referred to as "19 mm") and a second sized being defined by a 22.5 mm diameter block bore (nominally referred to as "22 mm"). Other sizes may also be defined by other bore diameters. As a result, in order to be able to replace tool picks as they wear out, it may be necessary to keep a stock of two or more differently sized tool pick assemblies, each tool pick assembly including a took pick, a sleeve retainer, and a washer. Similarly, it is necessary for a manufacturer of tool picks to manufacture two or more differently sized tool picks, or at least tool picks having two or more differently sized shanks, to be able to fulfill the needs of the differently sized block bores in the cutting tool assemblies out in the field.

Accordingly, there is a need in the art for an adaptive sleeve retainer to enable a tool pick sized to be received in a first bore diameter to be used in a second bore diameter, wherein the second bore diameter is smaller than the first bore diameter, without compromising the stability of the tool pick supported in the bore and without substantially changing the push out force required to remove the tool pick from the bore.

SUMMARY

A tool pick assembly is provided for insertion in a first bore having a first diameter. The tool pick assembly includes a tool pick having a shank with a diameter sized for receipt in a second bore having a second diameter, the second diameter being smaller than the first diameter, an adaptive sleeve retainer having a thickness for stably supporting the shank of the tool pick in the first bore, and a washer for compressing the adaptive sleeve retainer to aid insertion into the first bore. The adaptive sleeve retainer is configured to spring radially outward to retain the tool pick in the first bore, wherein a push out force for pushing the tool pick out from the first bore is approximately ±10% of a push out force for pushing out from the first bore a tool pick having a shank with a diameter sized for receipt in the first bore which is retained in the first bore using a compressible spring member having a thickness less than the thickness of the compressible spring member of the adaptive sleeve retainer.

An adaptive sleeve retainer is provided for retaining a tool pick in a first bore having a first diameter, the tool pick having a shank with a diameter sized for receipt in a second bore having a second diameter, the second diameter being smaller than the first diameter. The adaptive sleeve retainer includes a compressible spring member having a thickness for stably supporting the shank of the tool pick in the first bore, the compressible spring member being configured to spring radially outward to retain the tool pick in the first bore. A push out force for pushing the tool pick out from the first bore is within approximately ±10% of a push out force for pushing out from the first bore a tool pick having a shank with a diameter sized for receipt in the first bore which is retained in the first bore using a compressible spring member having a thickness less than the thickness of the compressible spring member of the adaptive sleeve retainer.

A cutting tool assembly is provided including a block having a first bore with a first diameter. The bore is adapted for receiving a tool pick assembly including a tool pick having a shank sized for receipt in the first bore. A tool pick is provided having a shank sized for receipt in a second bore with a second diameter, the second diameter being smaller than the first diameter. A compressible adaptive sleeve retainer is provided having a thickness for stably supporting the shank of the tool pick in the first bore, the adaptive sleeve retainer being configured to spring radially outward to retain the tool pick in the first bore, the adaptive sleeve retainer including means for engaging a retention groove in the shank of the tool pick. A washer compresses the adaptive sleeve retainer to aid insertion into the first bore. A push out force for pushing the tool pick out from the first bore approximately ±10% of a push out force for pushing out from the first bore a tool pick having a shank with a diameter sized for receipt in the first bore which is retained in the first bore using a compressible spring member having a thickness less than the thickness of the compressible spring member of the adaptive sleeve retainer.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which:

FIG. 2 is an exploded side elevation view of a tool pick assembly showing a tool pick, a washer, and an adaptive sleeve retainer of the present invention.

FIGS. 3A and 3B show comparative cross-sectional views of a sleeve retainer of the prior art and an adaptive sleeve retainer of the present invention, respectively.

DETAILED DESCRIPTION

Figure 1:
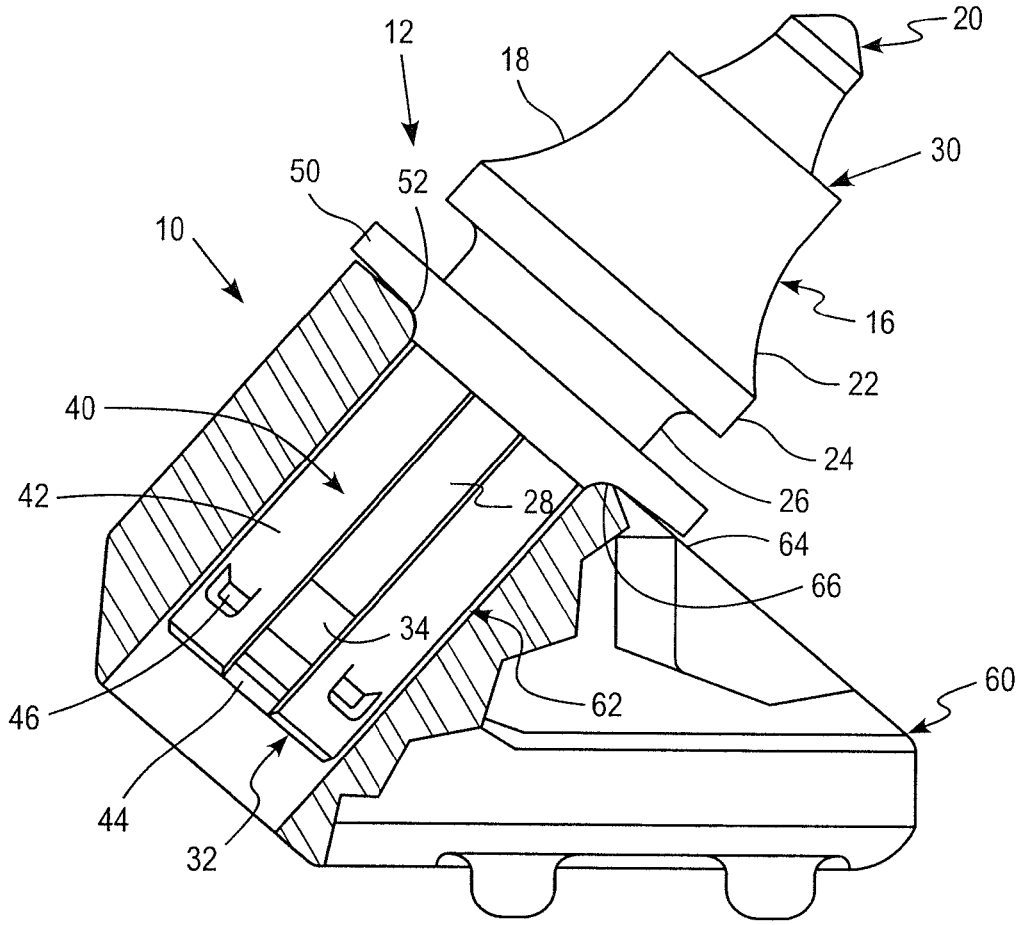
FIG. 1 is a side elevation view, partly in cross-section, showing an exemplary adaptive sleeve retainer of the present invention for holding a tool pick in a block.

FIG. 1 shows an exemplary embodiment of a cutting tool assembly 10, including a tool pick assembly 12 shown inserted in a bore 62 of a tool holder or block 60. The bore 62 is cylindrical or generally cylindrical, and has a diameter and an axial length. The tool pick assembly 12, as shown in the exploded view of FIG. 2, includes a tool pick 16, a compressible sleeve retainer 40, and a pre-compression washer 50 for compressing the compressible sleeve retainer 40 to facilitate insertion of the tool pick assembly 12 into the bore 62.

While the cutting tool assembly 10 is generally suitable for use as part of a road milling tool, it should be understood that the cutting tool assembly 10 is applicable to cutting tools other than road milling tools, such as for mining and trenching tools. When used as a road milling tool, a plurality of cutting tools are mounted around the circumference of a drum (not shown), and are rotatable around a longitudinal axis of the drum to thereby cut a hard surface.

The tool pick 16 has a first or front end 30 and a second or rear end 32. The tool pick 16 includes a tapered tool body 22, a cutting tip 20 projecting frontwardly from the tool body 22, and a major flare diameter portion 24 rearwardly adjacent to the tool body 22. A reduced diameter shoulder 26 is disposed adjacent to the major flare diameter portion 24, and is sized to receive the jaws of a standard extractor tool, as known in the art, such that the reduced diameter shoulder 26 serves as a puller groove. Projecting rearwardly form the reduced diameter shoulder 26 is a shank 28 having a diameter sized to be received in a corresponding bore 62 in a block 60. A portion of the shank 28 immediately adjacent to the reduced diameter shoulder 26 may have a diameter slightly larger than that of the shank 28 and may be designated as a washer seat 56. The structure of such a tool pick 12 is known in the art, and is shown for example in U.S. Pat. Pub. No. 2007/0257545, which is incorporated by reference herein in its entirety.

The tool pick 16 is retained in the bore 62 by a compressible sleeve retainer 40 disposed about at least a portion of the shank 28 of the tool pick 12. The sleeve retainer 40 includes a spring member 42 having an uncompressed diameter (or free diameter), an axial length, and a wall thickness. A contiguous slit 44 extends the entire axial length of the spring member 42, enabling the spring member 42 to be radially (i.e., circumferentially) compressed to a diameter smaller than the uncompressed diameter. As depicted, the slit 44 extends in a direction generally parallel to the axial length of the sleeve retainer 40. However, it is understood that the slit 44 can be of any contiguous shape that extends the entire axial length of the sleeve retainer 40, including but not limited to slanted, angled, stepped, etc. The slit 44 need not have a uniform opening dimension throughout, provided that the minimum opening dimension of the slit 44 is sufficient to enable the spring member 42 to be radially compressed from an uncompressed diameter to a diameter sufficiently small to fit in the bore 62.

The spring member 42 is made from a material, including but not limited to spring steel, that enables the spring member 42 to expand outwardly and to exert a radially outward force when the diameter of the spring member 42 is reduced to less than the uncompressed diameter. The radially outward force is a function of multiple factors, which may include the wall thickness of the spring member 42, the axial length of the spring member 42, the materials of construction of the spring member 42, and the amount by which the spring member 42 is compressed to less than the uncompressed diameter.

It is understood that the diameter of a bore 62 into which the tool pick assembly 12 is inserted is smaller than the uncompressed diameter of the spring member 42 of the sleeve retainer 40, such that the tool pick assembly 12 is retained within the bore 62 by the frictional force resulting from the radially outward force exerted on the walls of the bore 62 by the sleeve retainer 40. Therefore, the amount of frictional force generated by the sleeve retainer 40 on the walls of the bore 62 is a function of the same factors that determine the radially outward force of the spring member 42, including but not limited to the wall thickness of the spring member 42, the axial length of the spring member 42, the materials of construction of the spring member 42, the outer surface characteristics of the spring member 42, and the amount by which the diameter of the bore 62 is less than the uncompressed diameter of the spring member 42.

Figure 7:
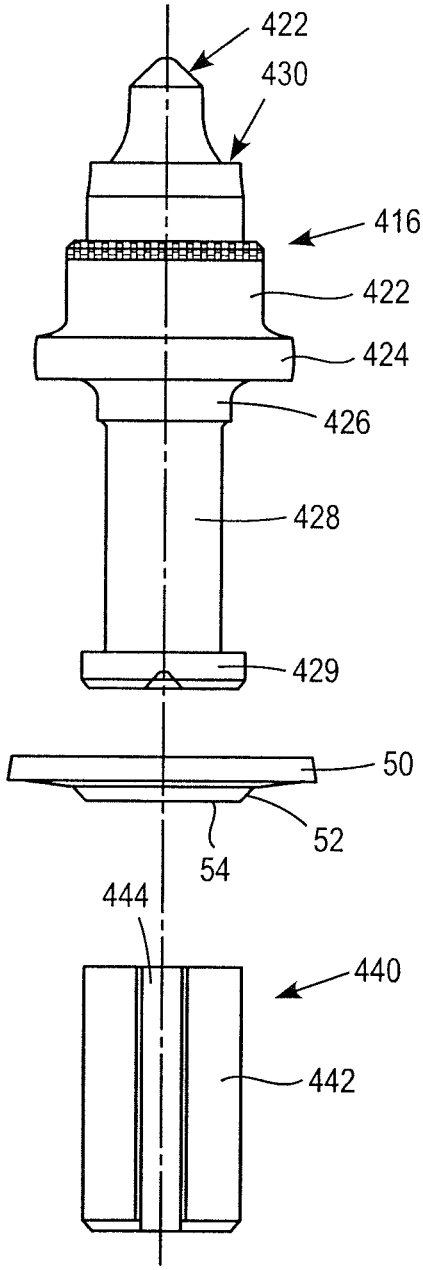
FIG. 7 is an exploded side view showing an alternate configuration of a tool pick shank and an adaptive sleeve retainer for retaining the tool pick in a bore.

The wall thickness of the spring member 42 is preferably slightly less than half the difference between the diameter of the bore 62 and the diameter of the shank 28 of the tool pick 16, such that with the exception of the axial slit 44, the sleeve retainer 40 generally fills an annular space between the shank 28 and the bore 62. However, the frictional force created between the shank 28 and the spring member 42 is typically substantially less than the frictional force created between the spring member 42 and the wall of the bore 62. Accordingly, means is provided for retaining the shank 28 of the tool pick 16 within the sleeve retainer 40 when the tool pick assembly 12 is inserted in the bore 62. As depicted in FIG. 1, the retaining means includes a plurality of retaining tabs 46 protruding radially inwardly from the spring member 42 for engaging a retention groove 34 disposed circumferentially about a portion of the shank 28. When the sleeve retainer 40 is compressed within the bore 62, the retaining tabs 46 project into the retention groove 34 to a diameter less than the diameter of the shank 28 itself, so that the tool pick 16 cannot be removed from the bore 62 without also removing the sleeve retainer 40. Therefore, because the sleeve retainer 40 is held within the bore 62 by the frictional force generated by the spring member 42, the tool pick 16 is also held in the bore 62 by the same force. It is understood that other equivalent tool pick retaining means can be used, such as known in the art. For example, a tool pick 416 can have a shank 428 including an enlarged portion 429 disposed at the rear end 432 thereof, the diameter of the enlarged portion 429 being larger than the inner diameter of a sleeve retainer 440 when a corresponding tool pick 412 is inserted in the bore 62, as shown in FIG. 7. Accordingly, the sleeve retainer 440 does not include retaining tabs. Other similarly functioning retaining means in the contemplation of one of ordinary skill in the art may also be used.

Figure 4A:
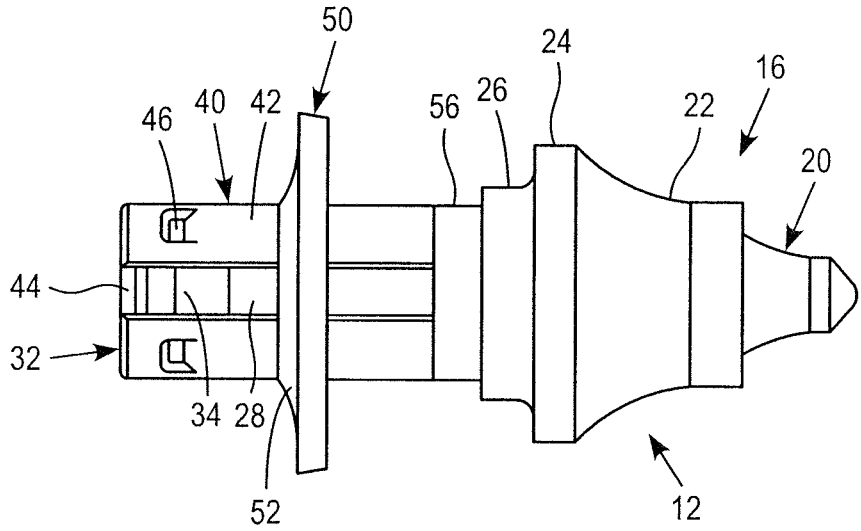
FIG. 4A is a side elevation view of a tool pick assembly including a tool pick, a washer, and an adaptive sleeve retainer of the present invention, wherein the washer is disposed along the axial direction of the adaptive sleeve retainer prior to insertion of the tool pick assembly in the bore of a block.

A washer 50 is provided to facilitate insertion of the shank 28 and sleeve retainer 40 into the bore 62. Prior to insertion of the tool pick assembly 12 into the bore 62, the sleeve retainer 40 is positioned about the shank 28. Then the sleeve retainer 40 is radially compressed as the washer 50 is fitted over the sleeve retainer 40 and positioned approximately midway along the axial length of the sleeve retainer 40, as shown in FIG. 4A. The washer 50 has a hole 54 sized to have a diameter approximately equal to or slightly smaller than the diameter of the bore 62, thereby enabling the sleeve retainer 40 to be inserted into the bore 62 against minimal frictional force.

Figure 4B:
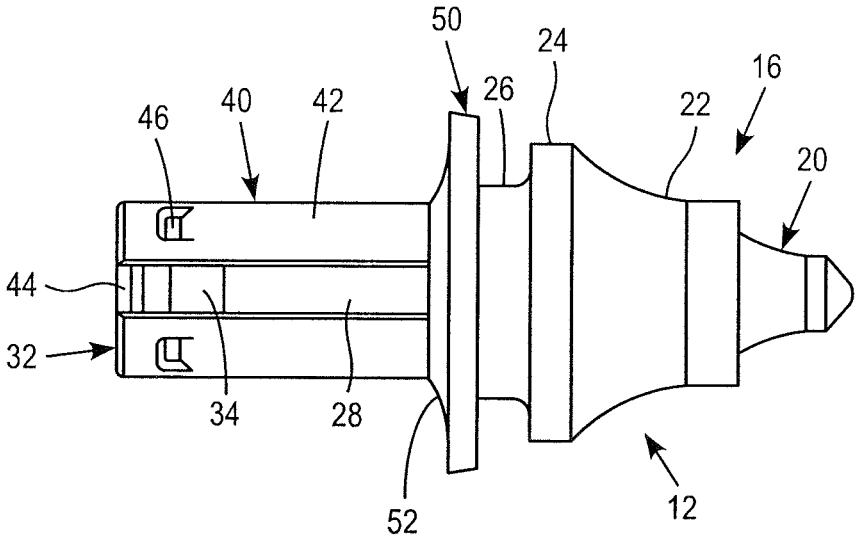
FIG. 4B is a side elevation view of a tool pick assembly including a tool pick, a washer, and an adaptive sleeve retainer of the present invention, wherein the washer is disposed at an end of the adaptive sleeve retainer after insertion of the tool pick assembly in the bore of a block.

Once the washer 50 is fitted about the sleeve retainer 40, the rear end 32 of the tool pick assembly 12 is inserted into the bore 62 of a block 60. During insertion of the tool pick assembly 12 into the bore 62, the washer 50 comes into contact with a face 64 of the block 60 when the sleeve retainer 40 and the shank 28 are about halfway into the bore 62. As the sleeve retainer 40 and shank 28 are further inserted into the bore 62, the washer 50 is pushed frontwardly with respect to the tool pick 16 until the shank 28 and the sleeve retainer 40 are fully inserted in the bore 62 and the washer 50 comes to rest on the washer seat 56 of the shank 28 with the washer 50 abutting the reduced diameter shoulder portion 26, as shown in FIG. 4B. As depicted in FIG. 1, the washer 50 includes a beveled portion 52 adapted to seat on a similarly shaped bevel 66 on the block face 64 adjacent to the bore 62.

When the shank 28 and the sleeve retainer 40 are fully inserted in the bore 62, the washer 50 no longer compresses the sleeve retainer 40, and thus the radially outward force of the spring member 42 presses the sleeve retainer 40 against the walls of the bore 62. However, because the frictional force between the sleeve retainer 40 and the shank 28 is typically substantially less than that between the sleeve retainer 40 and the bore 62, the shank 28, and thus the tool pick 16, is enabled to be rotated with respect to the block 60 while still being retained within the bore 62 by the retaining means. Rotation of the tool pick 16 within the bore 62 allows the cutting tip 20 of the tool pick 16 to wear symmetrically, which increases the life of the tool pick 16.

Conventional tool pick assemblies 12 are provided in at least two standard sizes, including a "19 mm" tool pick assembly for insertion in a bore having a diameter of approximately 19.9 mm (about 0.786") and a "22 mm" tool pick assembly for insertion in a bore having a diameter of approximately 22.5 mm (about 0.885").

A "19 mm" sleeve retainer for use in a "19 mm" bore, includes a spring member having a wall thickness of about 1.22 mm (about 0.048"), and correspondingly, the shank of the "19 mm" tool pick has a diameter of about 17.0 mm (about 0.669"), which is slightly smaller than the inside diameter of the compressed "19 mm" sleeve retainer after insertion into a "19 mm" bore. When the "19 mm" tool pick assembly is disposed in a "19 mm" bore, an annular gap of about 0.25 mm (about 0.010") exists between the shank and the spring member, while the spring member and the bore are in intimate contact. A "19 mm" washer for a "19 mm" assembly has a hole with a diameter approximately equal to or slightly less than the diameter of the "19 mm" bore. In one embodiment, the hole in the "19 mm" washer has a diameter of about 19.9 mm (about 0.785").

Similarly, a "22 mm" tool pick assembly sized for use in a "22 mm" bore employs a "22 mm" sleeve retainer with a spring member having a wall thickness of about 1.22 mm (about 0.048") such that the shank of the "22 mm" tool pick has a diameter of about 19.8 mm (about 0.779"). A "22 mm" washer for a "22 mm" assembly has a hole with a diameter approximately equal to or slightly less than the diameter of the "22 mm" bore. In one embodiment, the hole as a diameter of about 22.2 mm (about 0.875").

Because tool picks often wear out quickly, it is necessary to change out tool pick assemblies frequently; therefore, it is desirable that a modified tool assembly 12 as disclosed herein is removable from a bore 62 with a comparable amount of work as is required to remove a "22 mm" tool pick assembly from the same size bore 62.

Testing was conducted using a "22 mm" tool pick assembly to determine the push out force required to remove the "22 mm" assembly from a "22 mm" bore 62, using both as steady state application of force and an impact application of force. The "22 mm" tool pick assembly tested uses a sleeve retainer designated as model no. K92, which has a design similar to that depicted in FIG. 2. The push in force was not measured because when a pre-compression washer is employed, the push in force is not substantial and does not impact the ease of changing out tool pick assemblies. In steady state testing, the push out force was recorded continuously with displacement controlled at a rate of about 1 mm per second and the force was measured and recorded using an MTS 810 system. The "22 mm" tool pick assembly includes a "22 mm" sleeve retainer 140, as shown in cross-section in FIG. 3A, wherein the thickness of the "22 mm" sleeve retainer 140 is designated as t0. For the tested sleeve retainer 140, the thickness t0 was equal to about 0.048" (about 1.22 mm). The "22 mm" sleeve retainer 140 has an uncompressed diameter of in a range of about 23.1 mm (about 0.910") to about 23.9 mm (about 0.940") so that a compression in a range of about 2.7% to about 6.0% in diameter is required to fit the sleeve retainer 140 in a "22 mm" bore 62. In one embodiment, the "22 mm" sleeve retainer 140 has an uncompressed diameter of about 23.5 mm (about 0.925") and thus is compressed by about 4.5% in diameter to fit the "22 mm" sleeve retainer 140 in the "22 mm" bore 62, based on an absolute compression in diameter of about 1.0 mm (about 0.040") in diameter.

Figure 5:
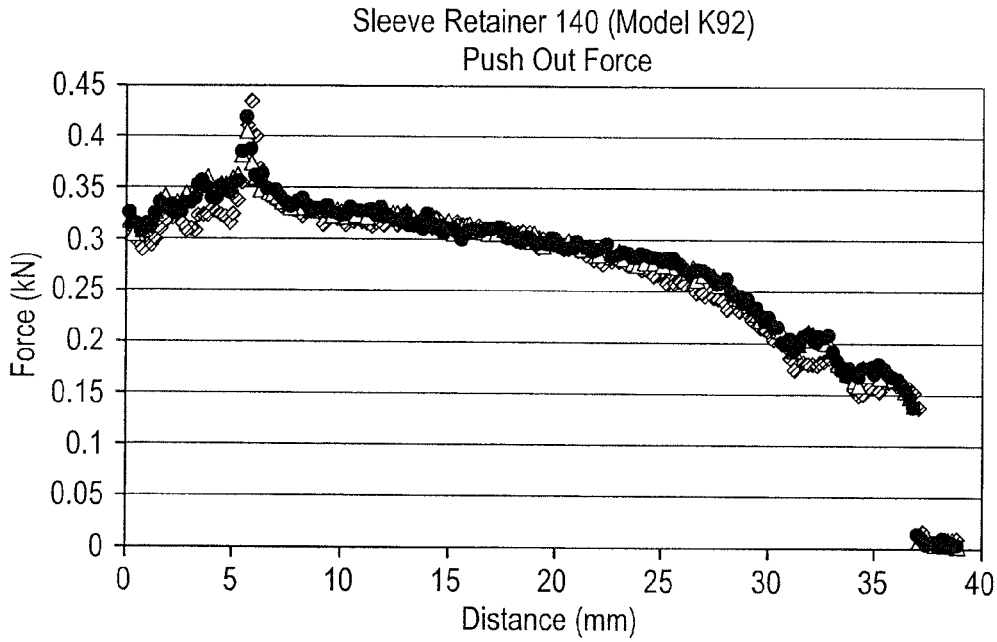
PRIOR ART FIG. 5
FIG. 5 is a graph plotting the steady state push out force versus distance for a tool pick assembly including a prior art sleeve retainer.

A steady state push out force curve for the "22 mm" tool pick assembly is shown in FIG. 5, which plots force (kN) against distance (mm). As is apparent from the graph, the axial length of the "22 mm" sleeve retainer 140 is about 37 mm. The axial length of the sleeve retainer 140 multiplied by the circumference of the bore 62 gives an approximate measure of the contact surface area between the bore and the sleeve retainer. Three push out curves are plotted together, showing that the push out force consistently starts at about 0.32 kN (about 72 lbs.), peaks at about 0.45 kN (about 100 lbs.) and slowly declines as the contact surface area between the "22 mm" sleeve retainer 140 and the wall of the bore 62 decreases, ultimately reaching less than about 0.15 kN (about 34 lbs.) by the time the "22 mm" pick tool assembly is completely pushed out of the "22 mm" bore 62. The cause of the peak in push out force at about 6 mm of push out is not known.

Although the steady state push out force is a reliable measure of the retention force of a tool pick assembly in a bore, tool pick assemblies are more typically removed in the field by repeatedly impacting the rear end of the assembly to drive the assembly out in a stepwise fashion from within the bore. Therefore, the impact push out force is relevant to how usable a tool pick assembly will be in the field. For the "22 mm" pick assembly, impact push out force was measured using a Kistler Model 9726A impulse force hammer to deliver and measure impact forces, and the output of the impulse force hammer was recorded (as voltage versus time) in real time using a picoscope. The output voltage was then converted to corresponding force values based on the calibration of the impulse force hammer. For the "22 mm" tool pick assembly, the maximum impulse force recorded was about 0.64 kN (about 140 lbs.), or about 1.4 times the maximum steady state force recorded for pushing out the same "22 mm" tool pick assembly from a bore 62.

For purposes of comparison, other tool pick assemblies having slightly different designs were tested, to provide an acceptable range of push out force measurements by which to evaluate the adaptive retainer sleeve disclosed herein.

Figure 8A:
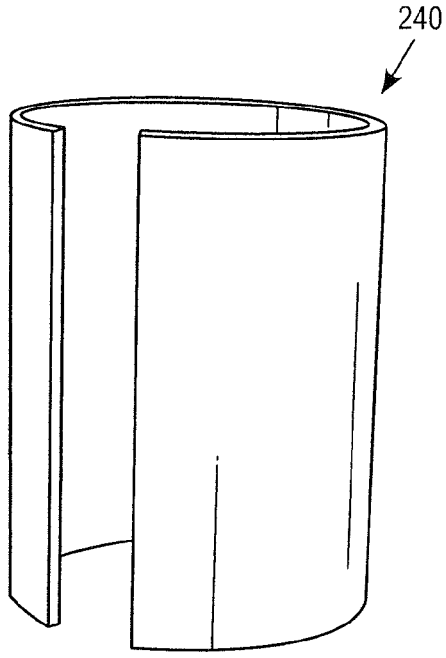
PRIOR ART FIG. 8A
FIGS. 8A and 8B are a perspective views showing comparative sleeve retainers used in comparative push out force testing.

One set of tests was conducted using a tool pick assembly having a sleeve retainer 240 designated as model no. K85, the K85 tool pick assembly being similar in design to the K92 tool pick assembly with the exception that the sleeve retainer of the K85 assembly has a slightly smaller wall thickness of about 0.040" (about 1.02 mm) as compared with about 0.048" (about 1.22 mm), and does not include retaining tabs. Also, the K85 assembly has an axial sleeve length about 31 mm, which is about 18% shorter than that of the K92 assembly. A sleeve retainer 240 used in a K85 assembly is shown in FIG. 8A. In steady state testing, the K85 assembly has a lower push out force than the K92 assembly, starting at about 0.12 kN (about 27 lbs.), peaking at about 0.15 kN (about 33 lbs.), and slowly declining to about 0.06 kN (about 14 lbs.) as the contact surface area between the K85 sleeve retainer 240 and the bore decreases. The peak impact push out force for the K85 assembly was about 0.25 kN (55 lbs.), or about 1.6 times the peak steady state push out force.

Figure 8B:
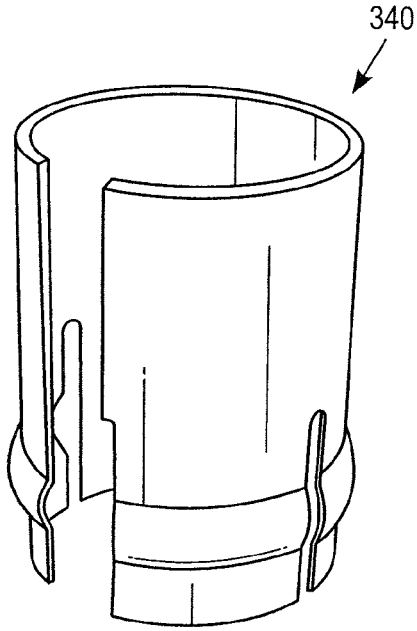
PRIOR ART FIG. 8B

Another set of tests was conducted using a tool pick assembly having a sleeve retainer 340 designated as model no. K98, the K98 tool pick assembly being different from the K92 tool pick assembly in that the sleeve of the K98 assembly has an outwardly protruding ridge and rearwardly disposed silts extending partway along the axial length of the sleeve, for use in retaining a tool pick therein. Also, the sleeve retainer 340 of the K98 assembly has a slightly smaller wall thickness of about 0.040" (about 1.02 mm) as compared with about 0.048" (about 1.22 mm) and a 37% shorter axial length of about 24 mm. A sleeve retainer 340 used in a K98 assembly is shown in FIG. 8B. In steady state testing, the K98 assembly has a higher peak push out force than the K92 assembly, primarily due to the force to overcome the outwardly protruding ridge near the start of push out. The push out force for the K98 assembly starts at about 0.20 kN (about 45 lbs.), peaks at about 1.2 kN (about 270 lbs.), and slowly declines to about 0.38 kN (about 85 lbs.) as the contact surface are between the K98 sleeve retainer 340 and the bore decreases. The peak impact push out force for the K98 assembly was about 1.5 kN (340 lbs.), or about 1.3 times the peak steady state push out force. It should be noted that aside from the high peak push out force due to the protruding ridge, the highest steady state push out force for the K98 assembly is about 0.7 kN (about 158 lbs.) which is more in line with the other tool pick assemblies tested.

For a user of cutting tools having blocks 60 with bores 62 of nominally "19 mm" (about 19.9 mm) and nominally "22 mm" (about 22.5 mm), it would be advantageous to avoid having to maintain stocks of two differently sized tool picks 16, a first size of tool pick 16 sized for use in a "19 mm" bore 62 and a second size of tool pick 16 sized for use in a "22 mm" bore 62. A tool pick assembly 12 using an adaptive sleeve retainer 40, as disclosed herein, provides such an advantage by enabling a tool pick 16 sized for use in a "19 mm" bore 62 to be used in a "22 mm" bore 62 while still enabling the resultant tool pick assembly 12 to be stably supported in the bore 62 and to be removed from the bore 62 by a push out force comparable to that required to remove a conventional "22 mm" tool pick assembly from the same "22 mm" bore 62. A tool pick 16 can be considered to be stably supported when the annular clearance between the shank 28 of the tool pick 16 and the adaptive sleeve retainer 40 is sufficient to inhibit wear due to lateral movement of the pick 16 within the adaptive sleeve retainer 40. In one embodiment, an annular clearance of less than or equal to about 0.75 mm (0.030") provides stable support for a shank 28 of a tool pick 16 within an adaptive sleeve retainer 40. A comparable push out force would be a force within a range above and below the push out force for a "22 mm" tool pick assembly 12 in the same size bore. In one embodiment, the range is about ±10% with respect to the push out force for a conventional "22 mm" tool assembly.

FIG. 2 depicts an exploded view of modified tool pick assembly 12 for use in a "22 mm" bore, including a "19 mm" tool pick 16 sized for use in a "19 mm" bore 62, an adaptive sleeve retainer 40 for retaining the "19 mm" sized tool pick 16 a "22 mm" bore 62, and a "22 mm" washer 50 for compressing the adaptive sleeve 40 to be inserted in a "22 mm" bore 62.

The adaptive sleeve retainer 40 for use with a "19 mm" tool pick 16 in a "22 mm" bore 62, as shown, includes a spring member 42 having a wall thickness of about 2.03 mm (about 0.080"), and correspondingly, the shank 28 of the tool pick 16 has a diameter of about 17.0 mm (about 0.665"), which is slightly smaller than the inside diameter of the compressed adaptive sleeve 40 after insertion into a "22 mm" bore 62. The wall thickness of the adaptive sleeve retainer 40 may be between about 55% and about 65% greater than the wall thickness of a conventional "22 mm" sleeve retainer 140, and is typically about 60% greater than a sleeve retainer 140 having a thickness of about 1.22 mm (about 0.048"). When the tool pick assembly 12 is disposed in the bore 62, an annular gap of about 0.75 mm (about 0.030") exists between the shank 28 and the spring member 42, while the spring member 42 and the bore 62 is in intimate contact. By comparison with the "22 mm" tool pick assembly 10, the annular gap is significantly larger. Although it was expected that a larger annular gap between the tool pick assembly 12 and the bore 62 than in a conventional "22 mm" assembly would result in accelerated wear to the inside of the bore 62, unexpectedly, such a problem did not materialize. In contrast, the larger annular gap in combination with a thicker spring member 42 resulted in advantages not expected—the larger annular gap promotes free rotation of the tool pick 16 within the adaptive sleeve retainer 40 while the additional thickness of the adaptive sleeve retainer 40 provides enhanced protection for the walls of the bore 62 by absorbing the impact forces caused by lateral movement of the pick 16 with the adaptive sleeve retainer 40. A "22 mm" washer 50 is used in the modified tool pick assembly 12 and has a hole 54 of approximately equal to or slightly less than about 22.2 mm (about 0.875").

It is understood that the force required to compress a sleeve retainer is proportional to the second moment of inertia of the sleeve retainer. Because the cross-section of a sleeve retainer is nominally a rectangle, the second moment of inertia is proportional to the axial length of the sleeve retainer times the cube of the thickness of the sleeve retainer. Thus, for the second moment of inertia of an adaptive sleeve retainer 40 having a thickness of 0.080" is about 4.1 times as large as with that of a "22 mm" sleeve retainer such as the K92 having a thickness of 0.048", based on a thickness ratio of 1.6. Therefore, it was expected that the thicker adaptive sleeve retainer 40 would have an excessively high radially outward force when compressed and inserted in a bore 62, such that the push out force of a tool pick assembly 12 including an adaptive sleeve retainer 40 would be excessively high, even if the uncompressed diameter of the adaptive sleeve retainer 40 were to be reduced proportional to thickness as compared with a "22 mm" sleeve retainer 140. In one embodiment, the uncompressed diameter of the adaptive sleeve retainer 40 was reduced to about "0.897" as compared with about 0.925" for a "22 mm" sleeve retainer 140, so that the "22 mm sleeve retainer 140 is compressed by about 3.3 times as much, in absolute measurement, as the adaptive sleeve retainer 40 when disposed in a "22 mm" bore 62 of about 0.885" diameter.

Testing was conducted using the modified tool pick assembly 12 to determine the push out force required to remove the assembly 12 from a "22 mm" bore The push in force was not measured because when a pre-compression washer 50 is employed, the push in force is not substantial and does not impact the ease of changing out tool pick assemblies 12. In steady state testing, the push out force was recorded continuously with displacement controlled at a rate of about 1 mm per second and the force was measured and recorded using an MTS 810 system. The modified tool pick assembly 12 includes a conventional "19 mm" tool pick 16, an adaptive sleeve 40 for adapting a "19 mm" tool pick 16 (sized for a "19 mm" bore 62) to be used in a "22 mm" bore 62, as shown in FIG. 4B. The thickness of the adaptive sleeve 40 is designated as t1. For the tested adaptive sleeve 40, the thickness t1 was equal to about 0.080" (about 2.03 mm). The adaptive sleeve retainer 40 has an uncompressed diameter in a range of about 22.5 mm (about 0.887") to about 23.0 mm (about 0.907") so that a compression in a range of about 0.2% to about 2.5% of diameter is required to fit the adaptive sleeve retainer 40 in a "22 mm" bore 62. In one embodiment, the adaptive sleeve retainer 40 has an uncompressed diameter of about 22.8 mm (about 0.897") and thus is compressed by about 1.3% in diameter to fit the adaptive sleeve retainer 40 in "22 mm" bore 62, based on an absolute compression in diameter of about 0.3 mm (about 0.012"). Thus, the uncompressed diameter of the tested embodiment of the adaptive sleeve retainer 40 ranged from less than about 1% to nearly about 6% smaller, and on average was approximately 3% smaller than the uncompressed diameter of a "22 mm" sleeve retainer 140, and the resultant absolute diametric compression of the adaptive sleeve retainer 40 was only about 30% of the absolute diametric compression of conventional "22 mm" sleeve retainer 140 to fit into a "22 mm" bore 62.

Figure 6:
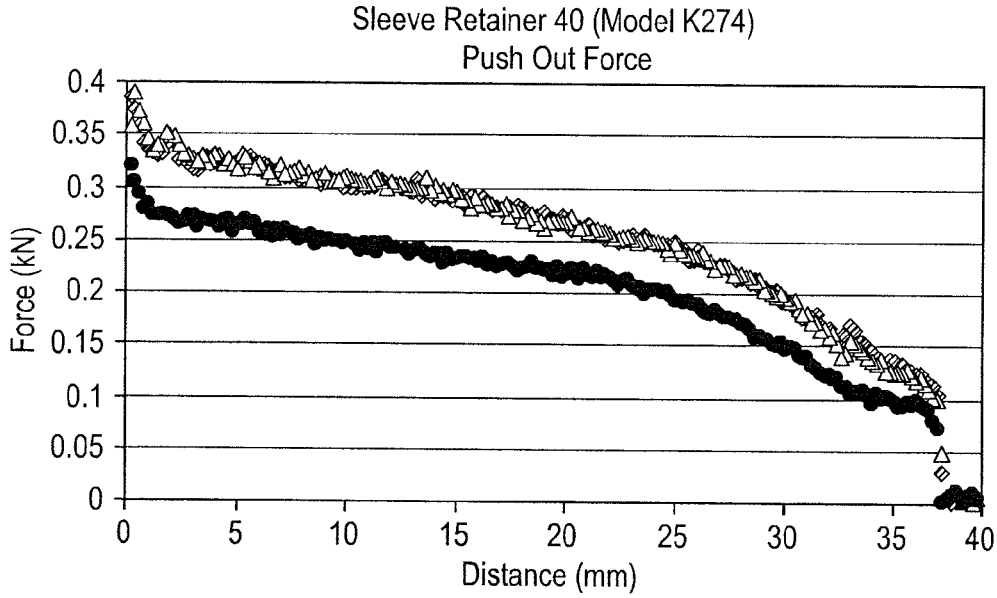
FIG. 6 is a graph plotting the steady state push out force versus distance for a modified tool pick assembly including an adaptive sleeve retainer of the present invention.

A steady state push out force curve for the modified tool pick assembly 12 is shown in FIG. 6, which plots force (kN) against distance (mm). As is apparent from the graph, the axial length of the adaptive sleeve 40 is about 37 mm. Three push out curves are plotted together, showing that the push out force starts at between about 0.32 kN (about 72 lbs.) and 0.40 kN (about 90 lbs.) and steadily declines as the contact surface area between the adaptive sleeve 40 and the wall of the bore 62 decreases, ultimate reaching between about 0.08 kN (about 18 lbs.) and about 0.10 kN (about 23 lbs.) by the time the pick tool assembly 16 is completely pushed out of the bore 62.

Impact push out force was measured using a Kistler Model 9726A impulse force hammer to deliver and measure impact forces, and the output of the impulse force hammer was recorded (as voltage versus time) in real time using a picoscope. The output voltage was then converted to corresponding force values based on the calibration of the impulse force hammer. For the modified tool pick assembly 12, the maximum impulse force recorded was about 0.58 kN (about 130 lbs.), or about 1.4 times the maximum steady state force recorded for pushing out the same modified tool pick assembly 12 from a bore 62.

Thus, for both the steady state and the impact testing, for the modified tool pick assembly 12 including the thicker-walled adaptive sleeve retainer 40 for enabling a "19 mm" tool pick 16 to be retained in a "22 mm" bore 62, the push out force was comparable to, and actually between about 7% and about 10% less than, the push out force for a "22 mm" pick assembly including a thinner-walled "22 mm" compressible sleeve retainer 140 for retaining a "22 mm" tool pick 16 in a "22 mm" bore 62.

In sum, an adaptive sleeve retainer 40 is disclosed herein to enable a tool pick 16 having a shank 28 sized for use in a bore 62 having a first diameter (e.g., a nominal "19 mm" diameter bore) to be used and retained in a bore 62 having a second larger diameter (e.g., a nominal "22 mm" diameter bore) without compromising the retention force and without compromising the ability to remove and replace the tool pick 16 as necessary.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A tool pick assembly for insertion in a first bore having a first diameter, the tool pick assembly comprising:

a tool pick having a shank with a diameter sized for receipt in a second bore having a second diameter, the second diameter being smaller than the first diameter;

an adaptive sleeve retainer having a thickness for stably supporting the shank of the tool pick in the first bore, the adaptive sleeve retainer being configured to spring radially outward to retain the tool pick in the first bore, wherein a push out force for pushing the tool pick out from the first bore is approximately ±10% of a push out force for pushing out from the first bore a tool pick having a shank with a diameter sized for receipt in the first bore which is retained in the first bore using a compressible spring member having a thickness less than the thickness of the compressible spring member of the adaptive sleeve retainer; and a washer for compressing the adaptive sleeve retainer to aid insertion into the first bore, wherein the first bore diameter is approximately 22.5 mm and the second bore diameter is approximately 19.9 mm, and wherein the diameter of the shank of the tool pick sized for receipt in the 19.9 mm second bore is approximately 17.0 mm and the diameter of the shank of a tool pick sized for receipt in the 22.5 mm first bore is approximately 19.8 mm.

2. The tool pick assembly of claim 1, further comprising a plurality of retaining tabs extending radially inwardly from the adaptive sleeve retainer for engaging a retention groove in the shank of the tool pick.

3. The tool pick assembly of claim 1, the adaptive sleeve retainer having an uncompressed diameter, wherein the push out force is determined at least in part by the difference between the uncompressed diameter and the first diameter of the first bore.

4. The tool pick assembly of claim 3, wherein the push out force is further determined at least in part by the thickness of the adaptive sleeve retainer.

5. The tool pick assembly of claim 1, wherein the adaptive sleeve retainer has a thickness in a range of approximately 55% to approximately 65% greater than the thickness of the sleeve retainer for retaining in the first bore the tool pick having a shank sized for receipt in the first bore.

6. The tool pick assembly of claim 1, wherein the adaptive sleeve retainer has an uncompressed diameter in a range of approximately 1% to approximately 6% smaller than that of the sleeve retainer for retaining in the first bore the tool pick having a shank sized for receipt in the first bore.

7. An adaptive sleeve retainer for retaining a tool pick in a first bore having a first diameter, the tool pick having a shank with a diameter sized for receipt in a second bore having a second diameter, the second diameter being smaller than the first diameter, the adaptive sleeve retainer comprising:

a compressible spring member having a thickness for stably supporting the shank of the tool pick in the first bore, the compressible spring member being configured to spring radially outward to retain the tool pick in the first bore, wherein a push out force for pushing the tool pick out from the first bore is within approximately ±10% of a push out force for pushing out from the first bore a tool pick having a shank with a diameter sized for receipt in the first bore which is retained in the first bore using a compressible spring member having a thickness less than the thickness of the compressible spring member of the adaptive sleeve retainer, and wherein the first bore diameter is approximately 22.5 mm and the second bore diameter is approximately 19.9 mm, and wherein the diameter of the shank of the tool pick sized for receipt in the 19.9 mm second bore is approximately 17.0 mm and the diameter of the shank of a tool pick sized for receipt in the 22.5 mm first bore is approximately 19.8 mm.

8. The adaptive sleeve retainer of claim 7, wherein the compressible spring member has an axial length, the adaptive sleeve retainer further comprising an axial gap extending the axial length of the compressible spring member.

9. The adaptive sleeve retainer of claim 7, further comprising:

a plurality of retaining tabs extending radially inwardly from the compressible spring member for engaging a retention groove in the shank of the tool pick.

10. The adaptive sleeve retainer of claim 7, the compressible spring member having an uncompressed diameter, wherein the push out force is determined at least in part by the difference between the uncompressed diameter and the first diameter of the first bore.

11. The adaptive sleeve retainer of claim 10, wherein the push out force is further determined at least in part by the thickness of the spring member.

12. The adaptive sleeve retainer of claim 7, wherein the spring member has a thickness in a range of approximately 55% to approximately 65% greater than the thickness of the sleeve retainer for retaining in the first bore the tool pick having a shank sized for receipt in the first bore.

13. The adaptive sleeve retainer of claim 7, wherein the adaptive sleeve has an uncompressed diameter in a range of approximately 1% to approximately 6% smaller than that of the sleeve retainer for retaining in the first bore the tool pick having a shank sized for receipt in the first bore.

14. A cutting tool assembly comprising:

a block having a first bore with a first diameter, the bore being adapted for receiving a tool pick assembly including a tool pick having a shank sized for receipt in the first bore;

a tool pick having a shank sized for receipt in a second bore with a second diameter, the second diameter being smaller than the first diameter;

a compressible adaptive sleeve retainer having a thickness for stably supporting the shank of the tool pick in the first bore, the adaptive sleeve retainer being configured to spring radially outward to retain the tool pick in the first bore, wherein a push out force for pushing the tool pick out from the first bore approximately ±10% of a push out force for pushing out from the first bore a tool pick having a shank with a diameter sized for receipt in the first bore which is retained in the first bore using a compressible spring member having a thickness less than the thickness of the compressible spring member of the adaptive sleeve retainer, the adaptive sleeve retainer including means for engaging a retention groove in the shank of the tool pick; and a washer for compressing the adaptive sleeve retainer to aid insertion into the first bore, wherein the first bore diameter is approximately 22.5 mm and the second bore diameter is approximately 19.9 mm, and wherein the diameter of the shank of the tool pick sized for receipt in the 19.9 mm second bore is approximately 17.0 mm and the diameter of the shank of a tool pick sized for receipt in the 22.5 mm first bore is approximately 19.8 mm.

15. The cutting tool assembly of claim 14, the adaptive sleeve retainer further having an uncompressed diameter, wherein the push out force is determined at least in part by the difference between the uncompressed diameter and the first diameter of the first bore.

16. The cutting tool assembly of claim 14, wherein the push out force is further determined at least in part by the thickness of the adaptive sleeve retainer.

17. The cutting tool assembly of claim 14, wherein the adaptive sleeve retainer has a thickness in a range of approximately 55% to approximately 65% greater than the thickness of the sleeve retainer for retaining in the first bore the tool pick having a shank sized for receipt in the first bore, and wherein the adaptive sleeve retainer has an uncompressed diameter in a range of approximately 1% to approximately 6% smaller than that of the sleeve retainer for retaining in the first bore the tool pick having a shank sized for receipt in the first bore.

18. A cutting tool assembly comprising:

a block having a first bore having a first bore diameter of approximately 22.5 mm, the bore being adapted for receiving a tool pick assembly including a tool pick having a shank sized for receipt in the first bore;

a tool pick having a shank having a shank diameter of approximately 17.0 mm;

a compressible adaptive sleeve retainer having a thickness for stably supporting the shank of the tool pick in the first bore, the adaptive sleeve retainer being configured to spring radially outward to retain the tool pick in the first bore, wherein a push out force for pushing the tool pick out from the first bore is approximately ±10% of a push out force for pushing out from the first bore a tool pick having a shank with a diameter sized for receipt in the first bore which is retained in the first bore using a compressible spring member having a thickness less than the thickness of the compressible spring member of the adaptive sleeve retainer, the adaptive sleeve retainer including means for engaging a retention groove in the shank of the tool pick; and a washer for compressing the adaptive sleeve retainer to aid insertion into the first bore.

19. The cutting tool assembly of claim 18, further comprising a plurality of retaining tabs extending radially inwardly from the adaptive sleeve retainer for engaging a retention groove in the shank of the tool pick.

20. The cutting tool assembly of claim 18, the adaptive sleeve retainer having an uncompressed diameter, wherein the push out force is determined at least in part by the difference between the uncompressed diameter and the first bore diameter.

21. The cutting tool assembly of claim 20, wherein the push out force is further determined at least in part by the thickness of the adaptive sleeve retainer.

* * * * *